US007753540B2

(12) United States Patent
Swantner et al.

(10) Patent No.: US 7,753,540 B2
(45) Date of Patent: Jul. 13, 2010

(54) ILLUMINABLE INDICATOR AND LIGHT ENGINE THEREFOR

(75) Inventors: Michael J. Swantner, Saxonburg, PA (US); Douglas G. Seymour, York, PA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 255 days.

(21) Appl. No.: 11/507,196

(22) Filed: Aug. 21, 2006

(65) Prior Publication Data

US 2008/0042867 A1 Feb. 21, 2008

(51) Int. Cl.
*F21V 29/00* (2006.01)

(52) U.S. Cl. ..... 362/30; 362/545; 362/294

(58) Field of Classification Search ..... 362/29, 362/30, 545, 555, 294, 373; 340/815.45
See application file for complete search history.

(56) References Cited

U.S. PATENT DOCUMENTS 6,498,355 B1 * 12/2002 Harrah et al. ..... 257/99
7,128,454 B2 * 10/2006 Kim et al. ..... 362/507
7,303,301 B2 * 12/2007 Koren et al. ..... 362/101
7,314,296 B2 * 1/2008 Machi et al. ..... 362/470
7,396,146 B2 * 7/2008 Wang ..... 362/294
2006/0050527 A1 * 3/2006 Rehberger et al. ..... 362/555
2007/0253209 A1 * 11/2007 Loh et al. ..... 362/458
2008/0186704 A1 * 8/2008 Chou et al. ..... 362/249

* cited by examiner

*Primary Examiner*—Stephen F. Husar
*Assistant Examiner*—Peggy A. Neils
(74) *Attorney, Agent, or Firm*—William H. McNeill; Shaun P. Montana

(57) ABSTRACT

An illuminable indicator (40) has an opaque base (42); a cover (44) for the base (42), the cover (44) having a formed design (46) therein having a given circumference with an area (48) defined by the circumference, the area (48) provided with a reflector (49) and at least the formed design being translucent; and mounting means (50) formed in the base for receiving a light engine (10).

1 Claim, 2 Drawing Sheets

ILLUMINABLE INDICATOR AND LIGHT ENGINE THEREFOR

TECHNICAL FIELD

This invention relates generally to illuminable indicators such as signs or other intelligence displaying indicia and to a light source for illuminating the indicator. Still more particularly it relates to indicators employing light emitting diodes (LED or LEDs) as the illumination-providing element.

BACKGROUND ART

Illuminable indicators have generally employed incandescent or fluorescent lamps for either direct illumination or backlighting. Such procedures worked better in protected environments. Outdoor illuminators often used neon tubing formed into a desired configuration. While all of these approaches worked well, they were difficult to maintain or service or were limited in the areas in which they could be employed.

DISCLOSURE OF INVENTION

It is, therefore, an object of the invention to obviate the disadvantages of the prior art.

It is another object of the invention to enhance illuminable indicators.

Still another object of the invention is provision of an illuminable indicator that is rugged, available for use in many environments, easy to service and inexpensive to manufacture.

These objects are accomplished, in one aspect of the invention, by an illuminable indicator comprising: an opaque base; a cover for the base, the cover having a formed design therein having a given circumference with an internal area defined by the circumference, the internal area provided with a reflector and the formed design being translucent; and mounting means formed in the base for receiving a light engine.

This design is simple and rugged and can be used in a variety of environments.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
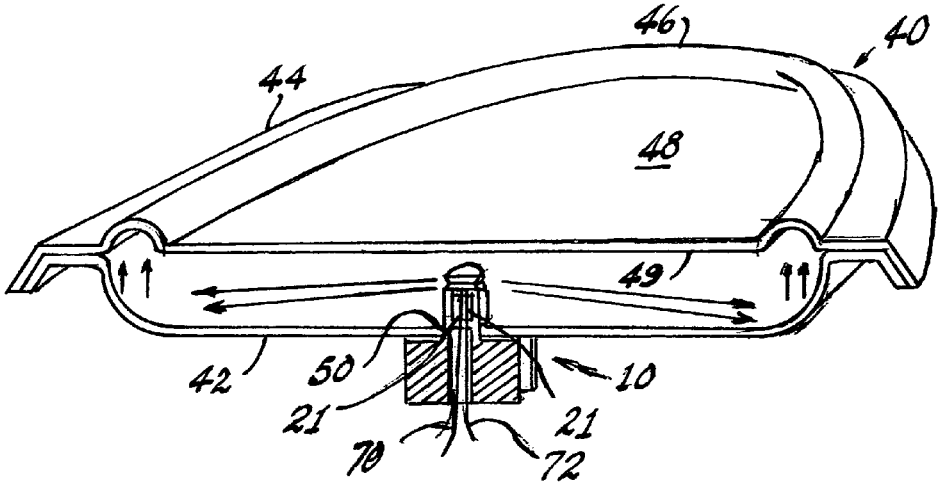
FIG. 1 is a partial, sectional view of an illuminable indicator in accordance with an aspect of the invention.
Figure 2:
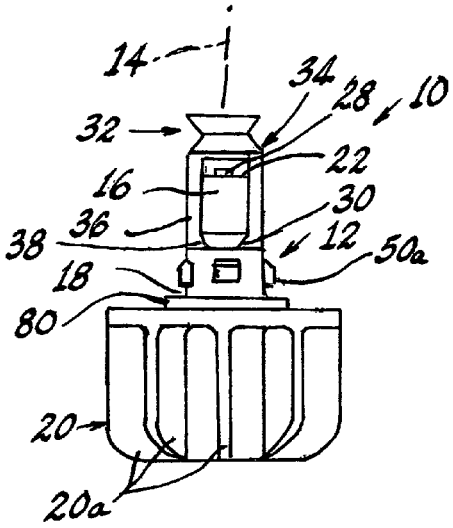
FIG. 2 is an elevational view, partially in section, illustrating a light engine for the indicator.

Referring now to the drawings in greater particularity, there is shown in FIG. 1 an illuminable indicator 40 comprising: an opaque base 42; a cover 44 for the base 42, the cover 44 having a formed design 46 therein having a given circumference with an internal area 48 defined by the circumference, the internal area 48 provided with a reflector and the formed design being translucent; and mounting means 50 formed in the base for receiving a light engine 10.

In a preferred embodiment the base 42 is substantially concave and injection molded from an ABS material. At least the interior of the base 42 is a glossy white in color to allow the light from the light engine to reflect in a diffuse manner, as shown in FIG. 1. The base 42 can have an extending, peripheral flange 60 to mate with a counterpart flange 62 on the cover 44 and the two flanges can be sealed together to weatherproof the indicator.

The cover 44 is made from a translucent material, such as an acrylic and can be thermoformed or injection molded. The formed design 46 is preferably raised above the level of the plane of the cover and generally has a given circumference. The actual shape will be whatever is desired, for example, an alphanumeric or other indicia. The circumference of the formed design defines an internal area 48 and this internal area 48 is provided with an opaque reflector 49, preferably with a mirror surface facing the light engine, as will be described hereinafter. The reflector 49 blocks any light emitted from the light engine and can be in the form of a "sticker" having an adhesive side opposite the mirror surface. When thus provided, any light generated by the light engine is directed only through the desired formed design 46, which can be hemispherical in cross-section.

Mounting means 50 is provided in the base 42 and, if only a single light engine is to be used, will be substantially centrally located. The mounting means 50 can comprise any of a number of techniques to mate with the light engine; for example, a tubular structure that is internally threaded to mate with external threads on the light engine. However, the preferred mounting means comprises a three-stud approach such as is used on most automobile taillights. As shown herein, three such studs 50*a* are provided on the middle portion 18.

Figure 3:
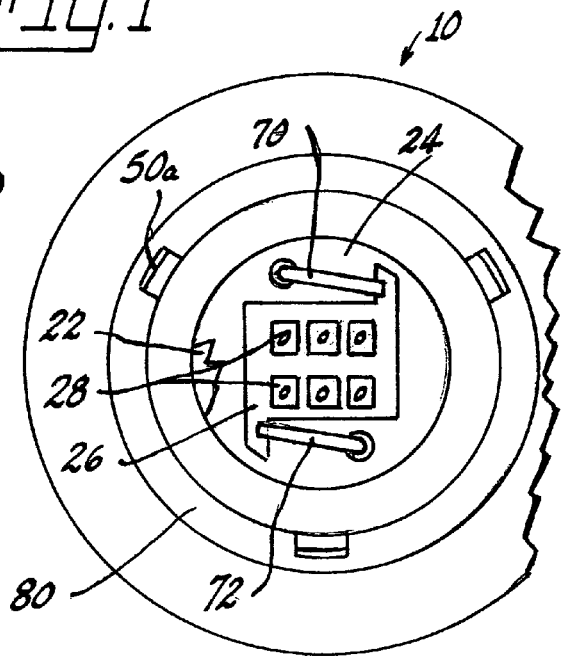
FIG. 3 is an enlarged plan view of the engine of FIG. 2.
Figure 4:
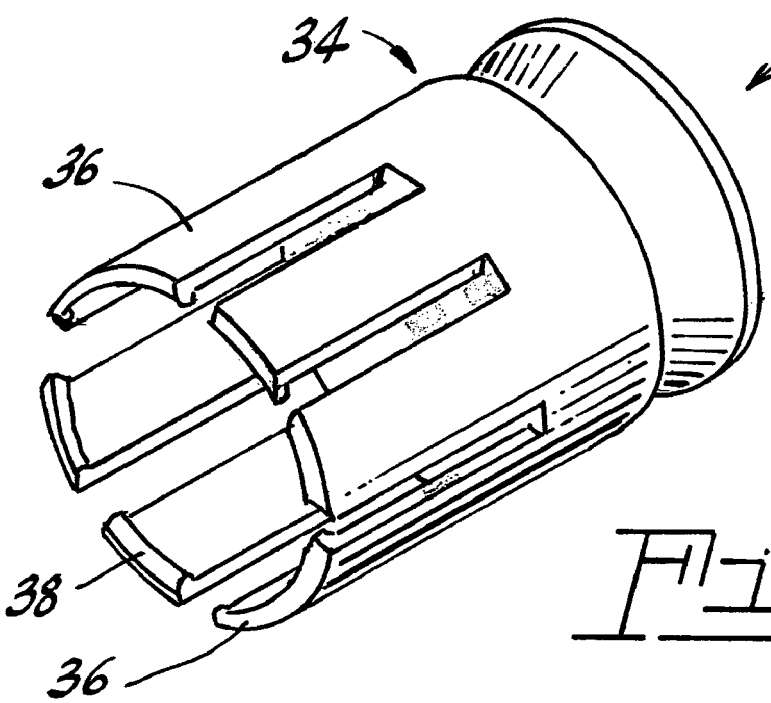
FIGS. 4 and 5 are perspective views of a lens for use with the invention.
Figure 5:
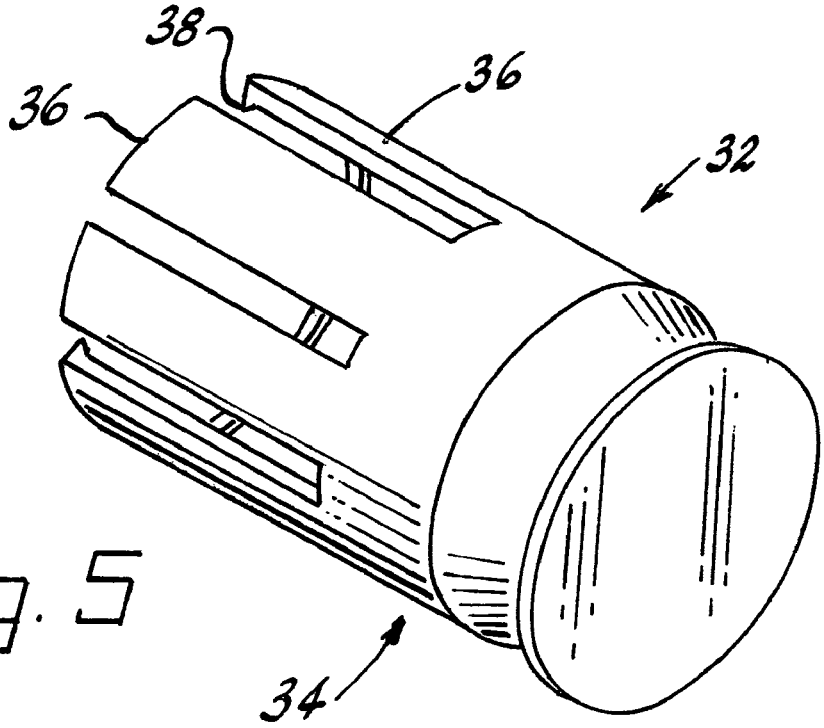

The light engine 10 for use with indicator 40 comprises a thermally conducting body 12 formed of a suitable material, such as die-cast zinc, that is substantially symmetrically arrayed about a longitudinal axis 14. The body 12 has a first end 16, a middle 18, and a second end 20, and at least two longitudinal passages 21 extending through the first end 16. A planar area 22 is formed at the first end 16 and is arrayed normal to the longitudinal axis 14. A thermally conductive dielectric 24, for example, a layer of ceramic-filled silicone, is placed on the planar area 22 and electrically conductive traces 26 are formed on the dielectric. LEDs 28 are secured to the dielectric and operatively connected to the electrically conductive traces. The passages 21 receive the connecting wires 70, 72 for supplying power to the LEDs and the wires 70, 72 are terminated at the conductive traces, as shown in FIG. 3.

The first end 16 of the light engine is cylindrical and is fitted with a lens 32. The lens 32 has a primary part 34 adjacent the LEDs 28 and a plurality of legs 36 extending therefrom. The legs 36 have projections or barbs 38 thereon that engage a circumferential groove 30 formed on first end 16. The action of the projections 38 in the groove 30 maintains the lens 32 in position.

To complete the assembly the light engine 10 is fitted into the mounting means 50 formed in the base 42. A gasket 80 surrounding the light engine at the junction of the first part 16 with the middle part 18 provides an environmental seal for the light engine.

Thus, there is provided an illuminable indicator that can be provided with many functions. It is economical to manufacture and has long life and can perform in many environmental situations. The light source of LEDs, even though having a very long life, is still easily replaceable and can be provided with a multiplicity of colors. Additionally, by providing the light engine 10 with the twist-lock feature comprising the three studs 50*a*, the light engine 10 can be used as in automobile lighting applications without any modifications. For example, by supplying the light engine 10 with red-emitting LEDs if can be utilized as a taillight; by using white-emitting LEDs a backup light can be provided. Alternatively, by providing the light engine 10 with white-emitting LEDs virtually any color desired can be supplied by coloring the lens 32.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. An illuminable indicator comprising:

an opaque base;

a cover for the base, the cover having a formed design therein having a given circumference with an area defined by the circumference, the area provided with a reflector and at least the formed design being translucent;

mounting means formed in the base for receiving a light engine, and a light engine fitted with said mounting means, said light engine comprising a thermally conducting body substantially symmetrically arrayed about a longitudinal axis, the body having a first end, a middle, and a second end, and at least two longitudinal passages extending from the second end to the first end;

said first end of said light engine being cylindrical and having a circumferential groove therearound and a lens fitted thereover, said lens having a primary part adjacent a plurality of LEDs and a plurality of legs extending therefrom, each of said legs having a terminus provided with a projection that engages said circumferential groove;

a planer area at the first end arrayed normal to the longitudinal axis;

a dielectric on the planar area;

electrically conductive traces formed on the dielectric; and said plurality of LEDs secured to the dielectric and operatively connected to the electrically conducive traces.

* * * * *